US011444424B2

(12) United States Patent
Susini et al.

(10) Patent No.: US 11,444,424 B2
(45) Date of Patent: Sep. 13, 2022

(54) MOUNTING SUPPORT INTENDED TO MAKE IT EASIER TO CONNECT AT LEAST ONE FREE CONNECTOR TO A COMPLEMENTARY CONNECTOR

(71) Applicant: SAGEMCOM BROADBAND SAS, Rueil-Malmaison (FR)

(72) Inventors: Dominique Susini, Rueil Malmaison (FR); Cécile Maurech, Rueil Malmaison (FR); Yann Le Henanff, Rueil Malmaison (FR); Stéphane Kohn, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 115 days.

(21) Appl. No.: 16/770,774

(22) PCT Filed: Dec. 14, 2018

(86) PCT No.: PCT/EP2018/085088
§ 371 (c)(1),
(2) Date: Jun. 8, 2020

(87) PCT Pub. No.: WO2019/121433
PCT Pub. Date: Jun. 27, 2019

(65) Prior Publication Data

US 2020/0395724 A1 Dec. 17, 2020

(30) Foreign Application Priority Data

Dec. 21, 2017 (FR) ..... 17 62853

(51) Int. Cl.
*H01R 43/26* (2006.01)
*H01R 13/422* (2006.01)
(Continued)

(52) U.S. Cl.
CPC ..... *H01R 43/26* (2013.01); *H01R 13/4226* (2013.01); *H01R 13/501* (2013.01); *H01R 13/631* (2013.01); *H01R 13/73* (2013.01)

(58) Field of Classification Search
CPC .. H01R 9/2416; H01R 13/631; H01R 13/501; H01R 43/26; H01R 13/73
See application file for complete search history.

(56) References Cited

U.S. PATENT DOCUMENTS 4,195,194 A * 3/1980 Kuster ..... H01R 4/2462 174/59
5,871,374 A 2/1999 Maney
(Continued)

FOREIGN PATENT DOCUMENTS

FR 2842656 A1 1/2004
JP S63-111779 U 7/1988
(Continued)

*Primary Examiner* — Briggitte R. Hammond
(74) *Attorney, Agent, or Firm* — Muncy, Geissler, Olds & Lowe, P.C.

(57) ABSTRACT

The invention relates to a mounting support intended to make it easier to connect at least one free connector to a complementary connector, the free connector being mounted at one end of an electric cable, the complementary connector being able to be mounted on an electronic board, the mounting support comprising a base and, for each free connector, a first impression and a second impression formed in a face of the base, the first impression being designed to receive a head of the free connector and comprising first holding means designed to keep the head of the free connector in the first impression, the second impression being designed to accommodate a connecting portion of the free connector and of the electric cable, and comprising second holding means designed to keep the connecting portion in the second impression.

12 Claims, 7 Drawing Sheets

(51) Int. Cl.

| | |
|---|---|
| ***H01R 13/50*** | (2006.01) |
| ***H01R 13/631*** | (2006.01) |
| ***H01R 13/73*** | (2006.01) |

(56) References Cited

U.S. PATENT DOCUMENTS

| | | | | |
|---|---|---|---|---|
| 5,921,807 | A * | 7/1999 | Okabe | H01R 13/501 439/467 |
| 2015/0270642 | A1 | 9/2015 | Cheng | |

FOREIGN PATENT DOCUMENTS

| | | | | |
|---|---|---|---|---|
| JP | 2011-159556 | A | 8/2011 | |
| WO | WO-2004010539 | A1 * | 1/2004 | H01R 9/223 |

* cited by examiner

MOUNTING SUPPORT INTENDED TO MAKE IT EASIER TO CONNECT AT LEAST ONE FREE CONNECTOR TO A COMPLEMENTARY CONNECTOR

The invention relates to the field of assembly supports intended to make it easier to connect at least one free connector to a complementary connector.

BACKGROUND OF THE INVENTION

The miniaturization of modern electrical equipment, the increase in the number of functions implemented, and the reduction of fabrication costs, all encourage the designers of said electrical equipment to use connectors that are small and fragile.

Thus, electrical equipment incorporating a wireless communication function, for example Wi-Fi, is conventionally provided with an electric cable provided at one end with a free connector of the "U.FL" type or equivalent. By way of example, such electrical equipment may be a residential gateway, a set-top box, a mobile phone, a tablet, a laptop computer, etc.

The use of this type of electric cable presents a certain number of risks, in particular when the electrical equipment is fabricated in the factory, or during a repair operation on the electrical equipment in after-sales service. These risks include the risk of damaging the free connector while it is being assembled on a complementary connector that is itself assembled on a printed circuit board (PCB) for example, the risk of connecting a wrong electric cable, and the risk of making a faulty connection between the free connector and the complementary connector.

OBJECT OF THE INVENTION

An object of the invention is to limit the above-described risks.

SUMMARY OF THE INVENTION

In order to achieve this object, there is provided an assembly support for making it easier to connect at least one free connector to a complementary connector, the free connector being mounted at one end of an electric cable, the complementary connector being suitable for mounting on a PCB, the assembly support comprising a base that is substantially flat in general shape and, for each free connector, a first recess and a second recess formed in a face of the base, the first recess being arranged to accommodate a head of the free connector and including first holder means arranged to hold the head of the free connector in the first recess, the second recess being arranged to accommodate a coupling portion coupling together the free connector and the electric cable, and including second holder means arranged to hold the coupling portion in the second recess.

The assembly support of the invention serves to preposition the free connector, to present it accurately facing the complementary connector, and to hold it in position during the operation of making the connection. This serves to reduce the risk of faulty assembly.

There is also provided a method of connecting a free connector to a complementary connector, the free connector being positioned at one end of an electric cable, and the method comprising the steps of:

positioning the head of the free connector in the first recess of an assembly support as described above;

positioning the coupling portion in the second recess;

presenting the face of the base of the assembly support so that it faces the complementary connector;

pressing on the top of the assembly support to connect the free connector to the complementary connector.

Other characteristics and advantages of the invention appear on reading the following description of particular, nonlimiting embodiments of the invention.

BRIEF DESCRIPTION OF THE DRAWINGS

Reference is made to the accompanying drawings, in which.

DETAILED DESCRIPTION OF THE INVENTION

Figure 1:
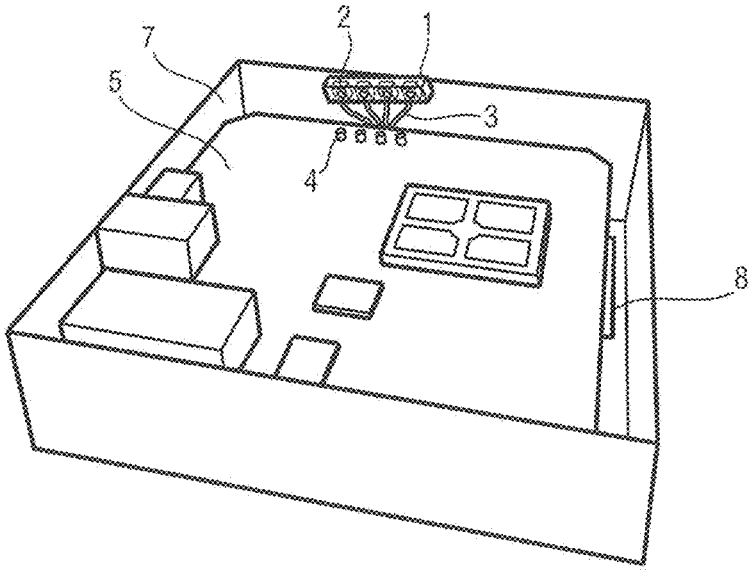
FIG. 1 shows a box and a PCB of electrical equipment, together with an assembly support of the invention.
Figure 2:
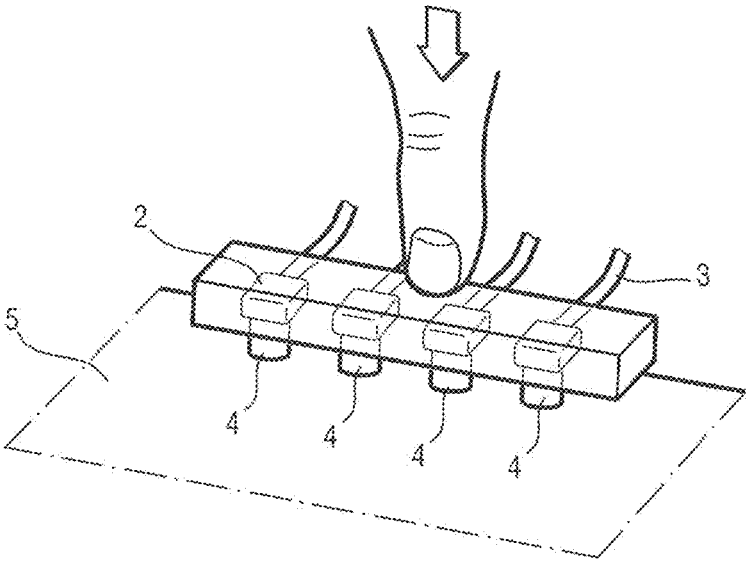
FIG. 2 shows free connectors being connected to complementary connectors using the assembly support.

In this example, and with reference to FIGS. 1 and 2, an assembly support of the invention 1 is for making it easier to connect four free connectors 2, each mounted at the end of a respective electric cable 3, on four complementary connectors 4 mounted in the proximity of an edge of a PCB 5.

This assembly is carried out by an operator during fabrication of the electrical equipment or during an operation of repairing the electrical equipment in after-sales service.

In this example, the electrical equipment is a residential gateway comprising a box 7, four antennas 8 and the PCB 5.

Each antenna 8 is connected to one of the electric cables 3. Thus, each electric cable 3 has one end connected to an antenna 8 and is provided at its other end with a free connector 2.

The four free connectors 2 are assembled in the assembly support 1. They are assembled securely firmly therein if the assembly support 1 is to remain in the residential gateway, or flexibly if the assembly support 1 is to be removed once the free connectors 2 have been assembled on the complementary connectors 4.

When fabricating the residential gateway, the operator installs the antennas 8 against the bottom of the box 7. Thereafter, PCB 5 is positioned over the antennas 8, against the antennas 8. The four electric cables 3 extend from the antennas 8, run close to an inside wall of box 7, pass over the PCB 5, and are then folded towards the inside of box 7.

The operator then takes hold of the assembly support 1, presents a face of a base of the assembly support 1 on which the free connectors 2 are positioned so that it faces the complementary connectors 4, and then presses on the top of the assembly support 1 in order to connect the free connectors 2 to the complementary connectors 4.

This greatly reduces the risk of damaging the free connectors 2 during assembly, the risk of connecting a wrong electric cable 3 (because the free connectors 2 and therefore the electrical cables 3 are pre-positioned on the assembly support 1), and the risk of making a faulty connection between the free connectors 2 and the complementary connectors 4.

The four free connectors 2 are connected to the four complementary connectors 4 in a single operation, which makes assembly much easier. The assembly can be verified merely by visual inspection at the time of fabrication, and there is no requirement for testing of the finished product.

Figure 3:
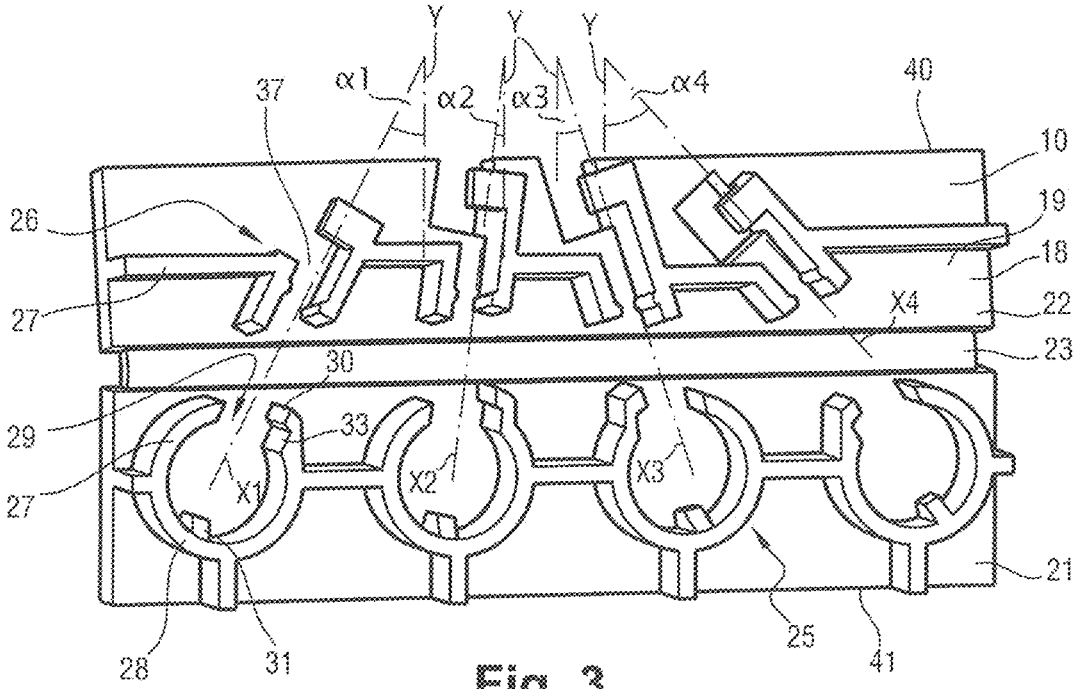
FIG. 3 shows an assembly support in a first embodiment of the invention.
Figure 4:
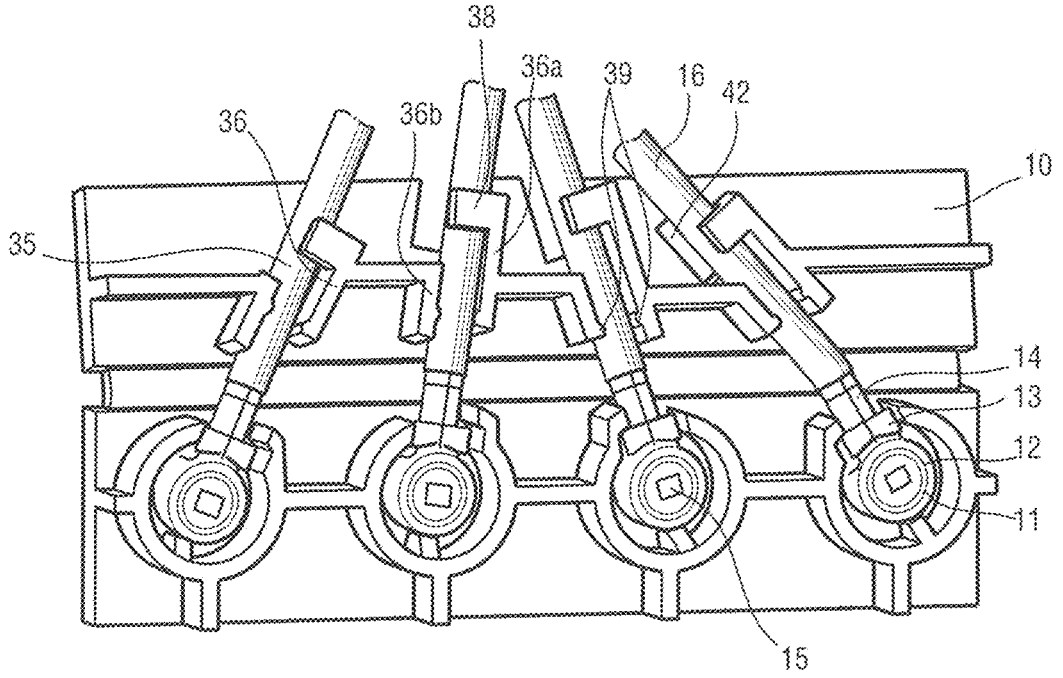
FIG. 4 shows the assembly support in the first embodiment of the invention, having free connectors positioned therein.

With reference to FIGS. 3 and 4, an assembly support in a first embodiment of the invention 10 is intended to accommodate four free connectors 11.

The description begins with the free connectors 11.

In this example, each free connector 11 is a female U.FL connector. In this example, each complementary connector is therefore a male U.FL connector.

Each free connector 11 comprises a head 12, a base 13, and a crimping barrel 14.

The head 12 has a generally cylindrical shape comprising metal walls inside which there extends a tubular female connection element 15. The base 13 extends from the metal walls of the head 12 perpendicularly to a height direction of the head 12. The crimping barrel 14 extends in line with the base 13. The free connector 11 is crimped on one end of the electric cable 16, via the crimping barrel 14.

There follows a description of the assembly support 10.

The assembly support 10 can be made of any type of material, which may be more or less flexible, and more or less hard: any plastics material, elastomer, etc. The assembly support 10 can be made of a material that is transparent in order to be able to see the PCB through the assembly support 10, so as to be able to present the assembly support accurately facing the complementary connectors.

This assembly support 10 comprises a base 18 of substantially flat general shape with four pairs of recesses, each comprising a first recess 25 and a second recess 26. The first recesses 25 and the second recesses 26 are formed on the same face 19 of the base 18.

Across its width, the base 18 has a first base portion 21 and a second base portion 22. The first base portion 21 and the second base portion 22 are held together by a flexible zone 23 forming a strip that extends in a length direction of the base 18. The flexible zone 23 presents thickness that is smaller than the thickness of the first base portion 21 or of the second base portion 22, thereby imparting flexibility thereto.

The first base portion 21 has four first recesses 25 arranged uniformly along the length of the base 18. The second base portion 22 has four second recesses 26 arranged uniformly along the length of the base 18. The first recesses 25 and the second recesses 26 are constituted by ribs 27 of rectangular section that project vertically from the base 18.

Each pair of recesses comprises a first recess 25 and a second recess 26 that is located facing the first recess 25 on the other side of the flexible zone 23, and each pair is for accommodating a corresponding free connector 11.

Each first recess 25 is arranged to accommodate the head 12 of the free connector 11.

Each first recess 25 has first holder means arranged to hold the head 12 of the free connector 11 in the first recess 25, with clearance allowing it to turn a certain amount about an axis of the head 12. By way of example, the clearance to turn may be clearance of 0.2 millimeters (mm).

The first recess 25 has a partially circular portion 28 in the form of a circle having an angular opening 29. A finger 30 is formed tangentially to a circumference of the circle, on the outside of the circle, and it extends into the angular opening 29 beyond the end 33 of the partially circular portion 28. The partially circular portion 28 also includes a radial peg 31 extending from the partially circular portion 28 towards the center of the circle.

The first holder means of the first recess 25 thus comprise the partially circular portion 28 and the radial peg 31, which form snap fastener means. When the head 12 of a free connector is put into place in the first recess 25, the partially circular portion 28 and the radial peg 31 deform a little so as to hold the head 12 by snap fastening. Since the angular opening 29 is of greater extent than the width of the base 13 of the free connector 11, the head 12 is held in the first recess 25 with clearance allowing it to turn about an axis of the head 12. The axis of the head 12 coincides with an axis of the tubular female connection element 15. The amount the head 12 can turn is limited by the end of the finger 30 and by the end of the partially circular portion 28, against which there come to bear respectively the crimping barrel 14 and the base 13 of the free connector 11.

Each second recess 26 is arranged to accommodate a coupling portion 35 coupling together the free connector 11 and the electric cable 16, and it comprises second holder means for fastening the coupling portion 35 in the second recess 26.

In this example, the coupling portion 35 is a certain length of the electric cable 16 that is situated in the proximity of the crimping barrel 14 of the free connector 11.

Each second recess 26 has two longitudinal ribs 36 that are parallel to each other and that form a passage 37 between the two longitudinal ribs 36. The two longitudinal ribs 36 are comprise a rib **36*a* and a rib 36*b*. The rib 36*a* is longer than the rib 36*b* of a rib portion. A tongue 38 extends from the top of the rib 36*b*, level with the rib portion, and parallel to a bottom of the passage 37**.

The inside wall of each longitudinal rib 36 includes a vertical rib 39 extending along the height direction of the longitudinal rib 36. Each vertical rib 39 is situated either at one end of a longitudinal rib 36, or else along the longitudinal rib 36.

In each pair of recesses the passage 37 of the second recess 26 is oriented so as to open out into the angular opening 29 of the partially circular portion 28 of the first recess 25.

The holder means of each second recess 26 thus comprise the longitudinal ribs 36, the vertical ribs 39, and the tongue 38.

The longitudinal ribs 36 and the vertical ribs 39 form snap fastener means. When the coupling portion 35 is positioned in the second recess 26, the longitudinal ribs 36 deform a little, thereby moving the vertical ribs 39 a little so as to snap fasten the coupling portion 35 that has just been positioned in the passage 37. The coupling portion 35 is then inserted under the tongue 38 so as to prevent it from escaping upwards from the passage 37.

It should be observed that the pairs of recesses, each extending along a respective longitudinal axis, are themselves arranged in a fan configuration from a first side 40 of the base 18 to a second side 41 of the base 18 opposite from the first side 40, the first side 40 and the second side 41 extending in the length direction of the base 18.

Thus, the angle between the longitudinal axis X1 and an axis Y perpendicular to the first side 40 is equal to $\alpha 1$, the angle between the longitudinal axis X2 and the axis Y is equal to $\alpha 2<\alpha 1$, the angle between the longitudinal axis X3 and the axis Y is equal to $-\alpha 2$, and the angle between the longitudinal axis X4 and the axis Y is equal to $-\alpha 1$.

The angular openings 29 of the partially circular portions 28 are themselves positioned so as to face the passages 37.

This fan arrangement makes it much easier to assemble free connectors 11 on the assembly support 10. Specifically, the electric cables 16 are relatively close together when they come from the antennas, and thereafter they are spaced apart from one another because of the space between the complementary connectors on the PCB.

Figure 5:
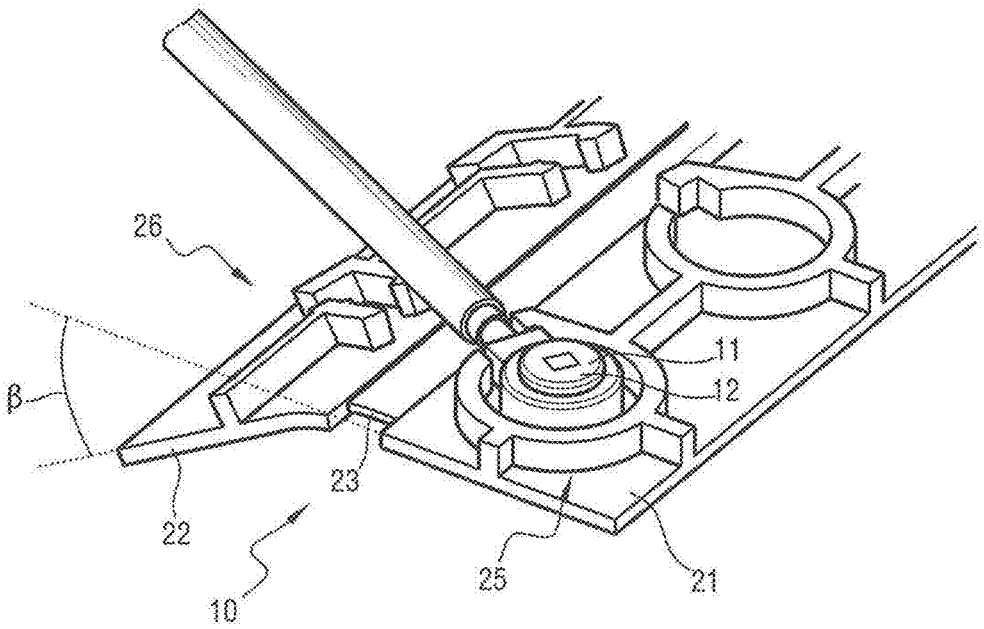
FIG. 5 shows a free connector being assembled in the assembly support.

With reference to FIG. 5, the free connectors 11 are assembled in the assembly support 10 in the first embodiment of the invention as follows.

An operator takes hold of the assembly support 10, and places the heads 12 of the free connectors 11 in the first recesses 25.

The operator bends the flexible portion 23 of the assembly support 10 by exerting a certain amount of pressure on the second base portion 22, thereby tilting the second base portion 22 at an angle $\beta$ greater than 180° relative to the first base portion 21.

The electric cables then extend a little above the second recesses 26.

The operator then releases the pressure being exerted on the second base portion 22. On being released, the second base portion 22 exerts a force against the coupling portions 35 of the electric cables. The angle $\beta$ is then close to 180°, and the coupling portions 35 of the electric cables become inserted in the second recesses 26.

The assembly support thus provides very practical and effective holding of the free connectors 11 in the assembly support 10.

It should be observed that some of the second recesses 26 are provided with a respective opening 42 formed through the base of the assembly support 10, under the tongue 38. The openings 42 enable the tongues 38 to be unmolded when fabricating the assembly support 10.

Figure 6:
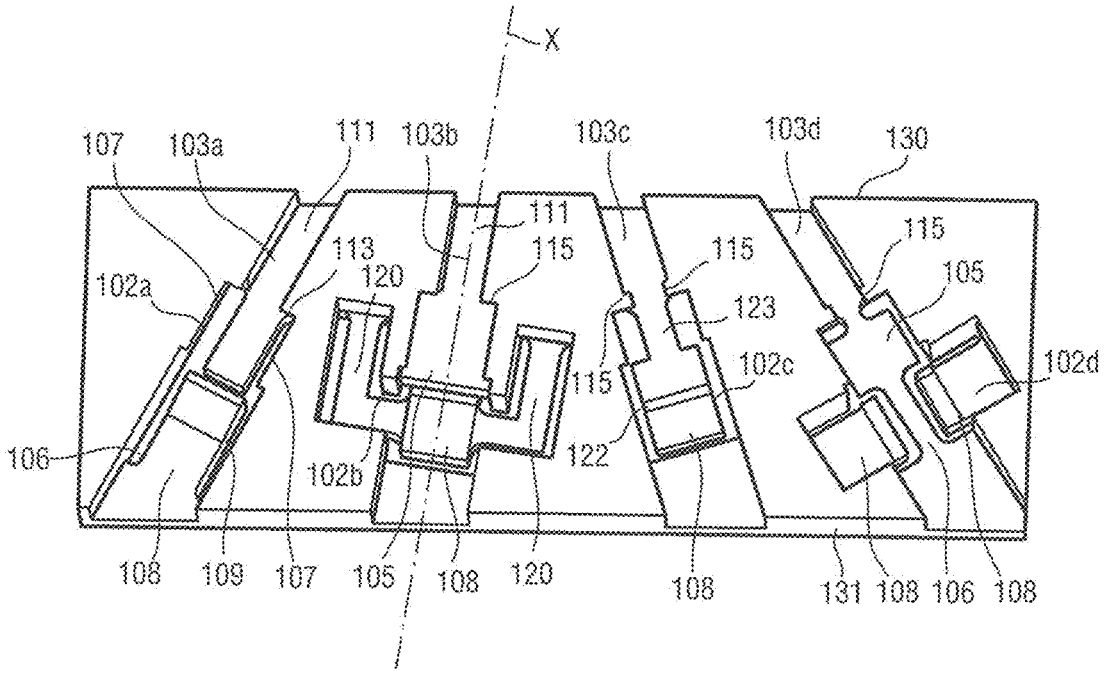
FIG. 6 shows an assembly support in a second embodiment of the invention.
Figure 7:
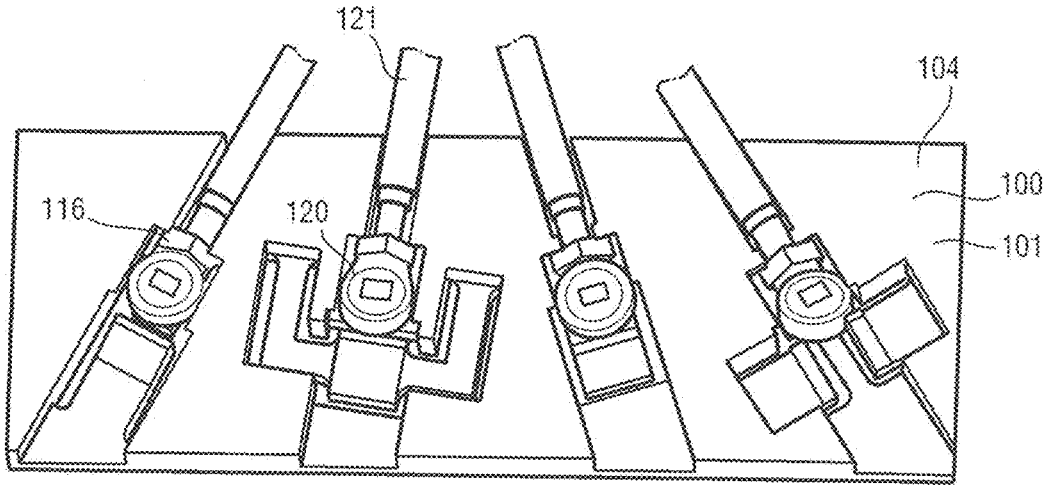
FIG. 7 shows the assembly support in the second embodiment of the invention, having free connectors positioned therein.

With reference to FIGS. 6 and 7, an assembly support 100 in a second embodiment of the invention comprises a base 101 of substantially flat general shape and four pairs of recesses, each comprising a first recess 102 and a second recess 103.

The first recesses 102 and the second recesses 103 are formed in the thickness of the base 101 from the same face 104 of the base 101.

It should be observed that the first recesses 102*a*, 102*b*, 102*c*, and 102*d* are different. On the final assembly support, it is naturally possible (but not essential) to select a single model for the first recess. This applies to all of the first recesses and to all of the second recesses in all of the embodiments described herein.

The first recess 102*a* has a first longitudinal groove 105 of a first width, and a second longitudinal groove 106 of a second width greater than the first width. The first longitudinal groove 105 and the second longitudinal groove 106 lie on the same axis.

The second longitudinal groove 106 opens out into the first longitudinal groove 105.

The first longitudinal groove 105 has longitudinal tongues 107 that project from the top edges of the first longitudinal groove 105 and that extend along said top edges.

A flexible tab 108 that is flexible in a direction perpendicular to the base 101 is formed in the second longitudinal groove 106. The flexible tab 108 extends lengthwise in the second longitudinal groove 106. At its free end, the flexible tab 108 has sloping extra thickness 109 forming a hook.

The base 101 includes longitudinal openings that extend in the edges of the first longitudinal groove 105 and of the second longitudinal groove 106.

The second recess 103*a* comprises a third longitudinal groove 111 of a third width that is less than the first width. The third longitudinal groove 111 lies on the same axis as the first longitudinal groove 105. The first longitudinal groove 105 opens out into the third longitudinal groove 111. The longitudinal tongues 107 extend over shoulders 113 situated at the junction between the first longitudinal groove 105 and the third longitudinal groove 111 so as to form wedge-shaped tongue portions 115.

The first holder means of the first recess 103*a* comprise the longitudinal tongues 107 and the flexible tab 108. When the free connector is assembled in the assembly support 100, the operator positions the head in the second longitudinal groove 106, which guides sliding of the head of the free connector in the assembly support 100 prior to it being positioned in the first longitudinal groove 105. The slope of the sloping extra thickness 109 makes it easier to insert the head in the first longitudinal groove 105. The head becomes positioned under the longitudinal tongues 107 and comes into abutment against the shoulders 113. Once snap fastened with the flexible tab 108, the head is held in the first longitudinal groove 105 under the longitudinal tongues 107 between firstly the free end of the flexible tab 108 and secondly the shoulders 113.

It should be observed that the first recess 102*a* is large enough for the first holder means to hold the head of the free connector in the first recess 102*a* with clearance allowing the head to turn about an axis.

The second holder means of the second recess 103*a* comprise the tongue portions 115.

A coupling portion 116 coupling together the free connector 120 and the electric cable 121, which is formed in this example by an external axial portion outside the base of the free connector, is positioned under the tongue portions 115. The external axial portion presents thickness that is less than the thickness of an internal axial portion of the base of the free connector, the internal axial portion being held in the first longitudinal groove 105.

The second recesses 103*b*, 103*c*, and 103*d* are similar to the second recess 103*a*.

In the first recess 102*b*, the flexible tab 108, which is situated in the second longitudinal groove 106, is carried by two arms 120 that extend in parallel on either side of the first longitudinal groove 105. After snap fastening with the flexible tab 108, the head is held in the first longitudinal groove 105 between firstly the free end of the flexible tab 108 and secondly the shoulder 124 situated at the junction between the first longitudinal groove 105 and the third longitudinal groove 111.

In the first recess 102*c*, the flexible tab 108 includes a longitudinal rib 122 situated in a central portion of the flexible tab 108, perpendicularly to the axis of the first longitudinal rib 105. The flexible tab 108 is carried by an arm 123 that extends in the first longitudinal groove 105. After snap fastening with the flexible tab 108, the head is held in the first longitudinal groove 105 between firstly the longitudinal rib 122 of the flexible tab 108 and secondly the shoulder situated at the junction between the first longitudinal groove 105 and the third longitudinal groove 111.

In the first recess 102*d*, two flexible tabs 108 extend in the second longitudinal groove 106, perpendicularly to its axis. The two flexible tabs 108 face each other, and each of them presents extra thickness at its free end. The extra thickness of each flexible tab 108 presents a slope that slopes towards the axis of the second longitudinal groove 106. The slopes of the extra thicknesses make it easier to insert the head in the first longitudinal groove.

It should be observed that the pairs of recesses, each extending along a respective longitudinal axis X, are arranged once again in a fan configuration from a first side 130 of the base 101 to a second side 131 of the base 101 opposite from the first side 130, the first side 130 and the second side 131 extending in the length direction of the base 101.

Figure 8:
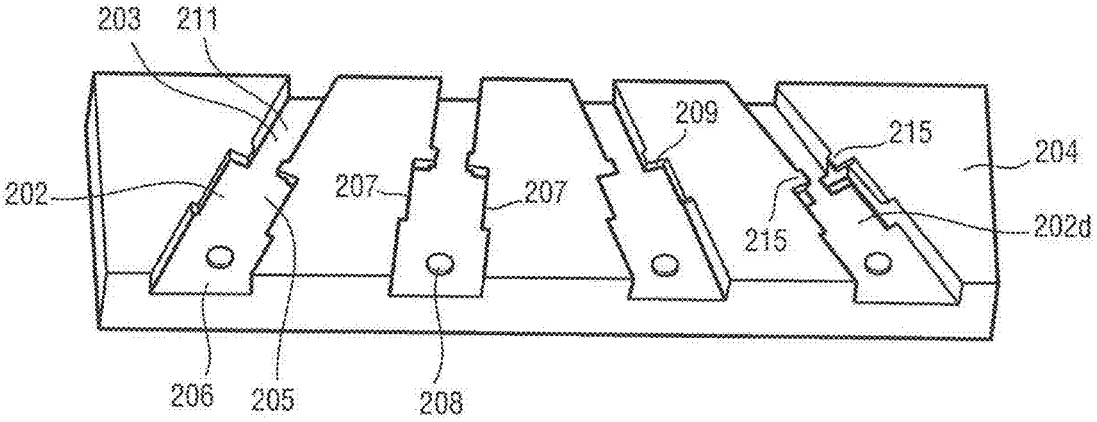
FIG. 8 shows an assembly support in a third embodiment of the invention.
Figure 9:
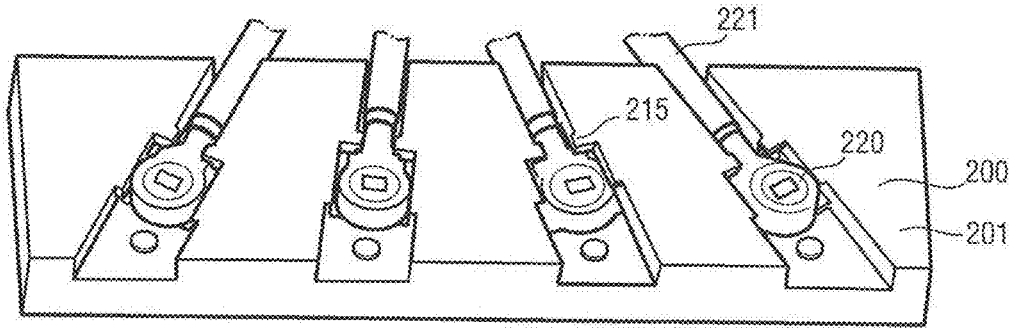
FIG. 9 shows the assembly support in the third embodiment of the invention, having free connectors positioned therein.

With reference to FIGS. 8 and 9, an assembly support 200 in a third embodiment of the invention comprises a base 201 of substantially flat general shape and four pairs of recesses, each comprising a first recess 202 and a second recess 203.

The first recesses 202 and the second recesses 203 are formed in the thickness of the base 201 from the same face 204 of the base 201.

Each first recess 202 has a first longitudinal groove 205 of a first width, and a second longitudinal groove 206 of a second width greater than the first width. The first longitudinal groove 205 and the second longitudinal groove 206 lie on the same axis.

The second longitudinal groove 206 opens out into the first longitudinal groove 205.

The first longitudinal groove 205 has longitudinal tongues 207 that project from the top edges of the first longitudinal groove 205 and that extend along said top edges.

A peg 208 extends vertically from a bottom wall of the second longitudinal groove 206.

Each second recess 203 comprises a third longitudinal groove 211 of a third width that is less than the first width. The first holder means of the first recess 202 comprise the peg 208, the shoulder 209 between the first longitudinal portion 205 and the third longitudinal portion 211, and the longitudinal tongues 207. When the free connector is assembled in the assembly support 200, the operator positions the head in the second longitudinal groove 206, which guides sliding of the head of the free connector in the assembly support 200 prior to it being positioned in the first longitudinal groove 205. The head comes into abutment against the shoulder 209. The head is held in the first longitudinal groove 205, under the longitudinal tongues 207, between firstly the peg 208 and secondly the shoulder 209.

The second recesses 203 are similar to the second recesses 103. The second holder means comprise the tongue portions 215.

A coupling portion 216 coupling together the free connector 220 and the electric cable 221, which is formed in this example by an external axial portion outside the base of the free connector, is positioned under the top tongue portions 215.

In the first recess 202*d*, an opening is formed in the sides of the first longitudinal groove 205 and at the interface between the first longitudinal groove 205 and the third longitudinal groove 211. Thus, only a thin strip of material 223 connects together the first longitudinal groove 205 and the third longitudinal groove 211.

It should be observed that the pairs of recesses are once again in a fan configuration from a first side of the base to a second side opposite from the first side, the first side and the second side extending in the length direction of the base.

Figure 10:
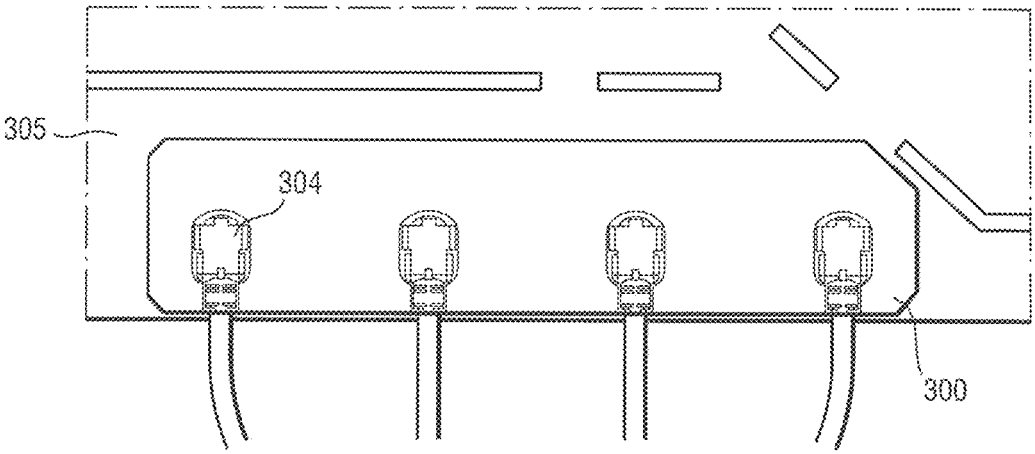
FIG. 10 shows a PCB and the assembly support in a fourth embodiment of the invention, having free connectors positioned therein.
Figure 11:
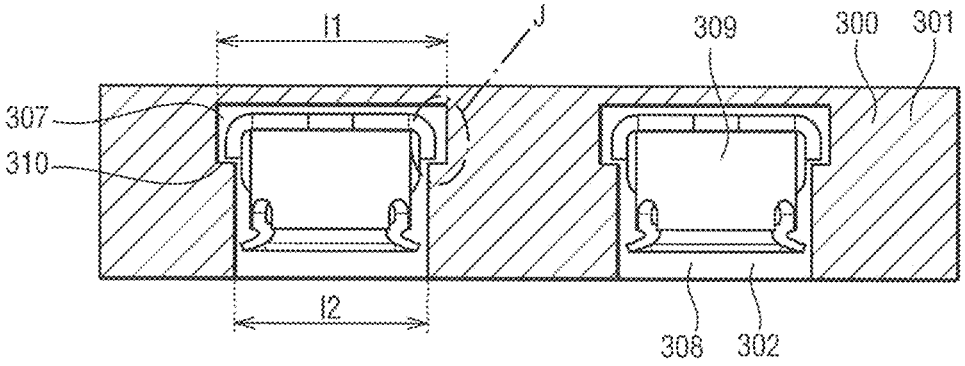
FIG. 11 shows free connector heads positioned in first recesses.

With reference to FIGS. 10 and 11, an assembly support 300 in a fourth embodiment of the invention comprises a base 301 of substantially flat general shape and four pairs of recesses, each comprising a first recess 302 and a second recess. The first recesses 302 and the second recesses are formed in the thickness of the base 301.

The assembly support 300 is made out of a material that is transparent, thereby making it easier to position the free connectors 304 on the complementary connectors of the PCB 305.

Each first recess 302 is a cavity comprising a first longitudinal groove 307 of width l1 and a second longitudinal groove 308 of width l2, where l2<l1, which grooves are superposed in the thickness of the base 301. The first longitudinal groove 307 lies at the end of the cavity and it opens out into the second longitudinal groove 308, which in turn opens out to the outside of the assembly support 300.

The head 309 of the free connector 304 is held in the first recess 302 by a shoulder 310 defined by the difference between the widths l1 and l2.

It should be observed that there exists clearance J enabling the head 309 of the free connector 304 to be positioned in the first recess. In this example, the clearance J is clearance of 0.2 mm.

Each second recess is a third longitudinal groove of width l3 less than l2. Each first recess opens out into a second recess.

The coupling portion, which is positioned in the second recess, is constituted in this example by a certain length of the electric cable situated in the proximity of the crimping barrel of the free connector.

It should be observed that the configuration of FIG. 11 may be implemented in all of the embodiments described herein.

Figure 12:
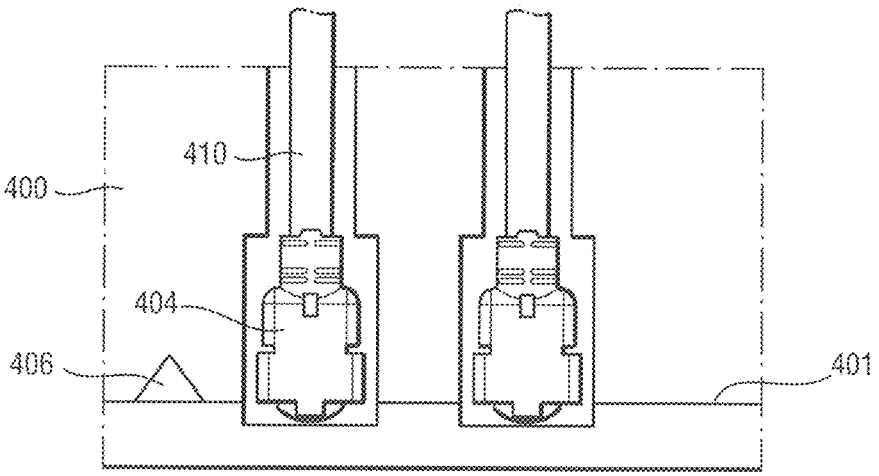
FIG. 12 shows the assembly support in a fifth embodiment of the invention, having free connectors positioned therein.

With reference to FIG. 12, an assembly support 400 in a fifth embodiment of the invention is similar to the assembly support 300 in the fourth embodiment of the invention, except that a hinge 401 extends in the length direction of the base of the assembly support 400. The hinge 401 subdivides the base into a first base portion 402 and a second base portion 403, defined across the width of the base.

The first base portion 402 and the second base portion 403 can thus be tilted relative to each other, thereby making it easier to assemble free connectors 404 in the assembly support 400.

The assembly support 400 includes locking means 406 that enable the first base portion 402 and the second base portion 403 to be secured to each other once the first base portion 402 and the second base portion 403 have been correctly positioned relative to each other. The assembly support 400 then becomes a rigid body that prevents the electric cables 410 or the crimping of the electric cables 410 being damaged when excessive stress is applied.

Whatever the embodiment, it should be observed that the assembly support may present guide elements such as pegs or nesting shapes. The guide elements serve to guide the assembly support on the PCB so as to improve the positioning of the free connectors on the complementary connectors.

Naturally, the invention is not limited to the embodiments described, but covers any variant coming within the ambit of the invention as defined by the claims.

The invention naturally applies to electrical equipment of any type, and by way of example it may be implemented in a set-top box, a mobile telephone, a tablet, a laptop computer, etc.

The number of pairs of recesses, and thus the number of free connectors for positioning on the assembly support, may naturally be other than four.

The invention claimed is:

1. An assembly support for making it easier to connect at least one free connector to a complementary connector, the free connector being mounted at one end of an electric cable, the complementary connector being suitable for mounting on a PCB, the assembly support comprising a base that is substantially flat in general shape and, for each free connector, a first recess and a second recess formed in a face of the base, the first recess being arranged to accommodate a head of the free connector and including first holder means arranged to hold the head of the free connector in the first recess, the second recess being arranged to accommodate a coupling portion coupling together the free connector and the electric cable, and including second holder means arranged to hold the coupling portion in the second recess, wherein the base comprises a first base portion and a second base portion, the assembly support being arranged so that the first base portion and the second base portion can be tilted relative to each other, and wherein the first base portion includes the first recess and the second base portion includes the second recess.

2. The assembly support according to claim 1, wherein the first holder means are arranged to hold the head of the free connector in the first recess with clearance allowing the head to turn about an axis of the head.

3. The assembly support according to claim 1, wherein the first recess and the second recess are formed in a thickness of the base.

4. The assembly support according to claim 1, wherein the first recess and the second recess comprise ribs extending from the base.

5. The assembly support according to claim 1, including a flexible zone situated between the first base portion and the second base portion, and suitable for being flexed.

6. The assembly support according to claim 1, including a hinge situated between the first base portion and the second base portion.

7. The assembly support according to claim 1, the assembly support being arranged in such a manner that, when the head of the free connector is positioned in the first recess and the second base portion is tilted relative to the first base portion by an angle greater than 180°, moving the second base portion towards the first base portion causes the coupling portion to be inserted into the second recess.

8. The assembly support according to claim 1, wherein the first holder means and/or the second holder means comprise snap fastener means.

9. The assembly support according to claim 8, wherein the snap fastener means include a flexible tab that is flexible in a direction perpendicular to the base.

10. The assembly support according to claim 1, the first recess including a first longitudinal groove and a second longitudinal groove opening out into the first longitudinal groove, the second longitudinal groove being arranged to guide sliding of the head of the free connector in the assembly support prior to the head being positioned in the first longitudinal groove.

11. Electrical equipment including a complementary connector, an electric cable having a free connector positioned at one end of the electric cable, and an assembly support according to claim 1.

12. A method of connecting a free connector to a complementary connector, the free connector being positioned at one end of an electric cable, and the method comprising the steps of:

positioning the head of the free connector in the first recess of an assembly support according to claim 1;

positioning the coupling portion in the second recess;

presenting the face of the base of the assembly support so that it faces the complementary connector;

pressing on the top of the assembly support to connect the free connector to the complementary connector.

* * * * *